US011564539B2

(12) United States Patent
Chen

(10) Patent No.: US 11,564,539 B2
(45) Date of Patent: Jan. 31, 2023

(54) CENTRAL VACUUM SYSTEM

(71) Applicant: Jianping Chen, Winnipeg (CA)

(72) Inventor: Jianping Chen, Winnipeg (CA)

( * ) Notice: Subject to any disclaimer, the term of this patent is extended or adjusted under 35 U.S.C. 154(b) by 301 days.

(21) Appl. No.: 16/917,576

(22) Filed: Jun. 30, 2020

(65) Prior Publication Data

US 2020/0329931 A1 Oct. 22, 2020

Related U.S. Application Data

(63) Continuation of application No. PCT/CN2018/000435, filed on Dec. 28, 2018.

(30) Foreign Application Priority Data

Jan. 2, 2018 (CN) ..... 201810001072.6

(51) Int. Cl.

| | |
|---|---|
| ***A47L 5/38*** | (2006.01) |
| ***A47L 9/12*** | (2006.01) |
| ***A47L 9/24*** | (2006.01) |
| ***A47L 9/28*** | (2006.01) |

(52) U.S. Cl.

CPC ..... *A47L 5/38* (2013.01); *A47L 9/12* (2013.01); *A47L 9/246* (2013.01); *A47L 9/248* (2013.01); *A47L 9/2821* (2013.01)

(58) Field of Classification Search

CPC ... A47L 5/38; A47L 9/12; A47L 9/246; A47L 9/248; A47L 9/2821

USPC ..... 15/314, 319, 339, 412

See application file for complete search history.

(56) References Cited

U.S. PATENT DOCUMENTS 5,274,878 A * 1/1994 Radabaugh ..... A47L 5/38 15/314
5,893,194 A * 4/1999 Karmel ..... A47L 5/38 15/422.2
5,924,163 A * 7/1999 Burns, Jr. ..... A47L 9/2894 15/314

(Continued)

FOREIGN PATENT DOCUMENTS

CN 101808559 A 8/2010
CN 105782628 A 7/2016

(Continued)

OTHER PUBLICATIONS

ISA/CN, International Search Report in counterpart international application No. PCT/CN2018/000435, dated Mar. 28, 2019.

(Continued)

*Primary Examiner* — Joseph J Hail
*Assistant Examiner* — Shantese L McDonald
(74) *Attorney, Agent, or Firm* — ATMAC Patent Services Ltd.; Andrew T. MacMillan

(57) ABSTRACT

Disclosed is a central vacuum system. The central vacuum system comprises a first vacuum device, a second vacuum device, and a hose connected between the first vacuum device and the second vacuum device; the first vacuum device and the second vacuum are controlled by a linked switch, interior of the hose remains positive or slightly negative pressure. A self-operated differential pressure regulating valve arranged at the end of the hose is capable of generating corresponding air resistance under different airflow rate so as to maintain the interior pressure of the hose at a stable slightly positive or negative pressure.

5 Claims, 4 Drawing Sheets

(56) References Cited

U.S. PATENT DOCUMENTS

| | | | | |
|---|---|---|---|---|
| 6,856,113 | B1 * | 2/2005 | Cunningham | A47L 9/2805 310/85 |
| 2014/0053364 | A1 * | 2/2014 | Vasudeva | A47L 11/4013 15/322 |

FOREIGN PATENT DOCUMENTS

| | | | | |
|---|---|---|---|---|
| CN | 107022816 | A | 8/2017 | |
| CN | 108158487 | A | 6/2018 | |
| JP | 2012125528 | * | 7/2012 | A47L 9/00 |
| JP | 2012125528 | A | 7/2012 | |

OTHER PUBLICATIONS

ISA/CN, Written Opinion of the International Search Authority in counterpart international application No. PCT/CN2018/000435, dated Mar. 28, 2019.

* cited by examiner

CENTRAL VACUUM SYSTEM

CROSS-REFERENCE TO RELATED APPLICATIONS

This application is a continuation application of the international application No. PCT/CN2018/000435, filed Dec. 28, 2018, which claims priority to Chinese Application No. 201810001072.6, filed on Jan. 2, 2018, entitled "CENTRAL VACUUM SYSTEM AND RETRACTABLE HOSE THEREOF". The contents of all these applications are hereby incorporated by reference.

TECHNICAL FIELD

The present disclosure relates to a vacuum system, especially to a central vacuum system.

BACKGROUND

There are two common vacuum systems available, one including a motor placed in the same room with the fan, the filter, and the suction port, e.g., household vacuum cleaner; the other including a motor, a fan and a filter placed separately from the suction port, e.g., central vacuum system. These two kinds of vacuum systems have their advantages and disadvantages respectively. The household vacuum cleaners, especially the handheld vacuum cleaner, have the advantages of short pipelines, low power, and lightness. However, they also have disadvantages including loud indoor noise, small filtering area, and more cleaning difficulty. Even worse, they may cause the pollution of dust re-entrainment. The central vacuum system is on the opposite side of the household vacuum cleaner. It requires greater host power and bulky movable hose. However, the central vacuum system has advantages including larger filtering area, easier cleaning, lower indoor noise. Furthermore, the central vacuum system will not stir up the dust re-entrainment.

SUMMARY OF THIS INVENTION

The object of the present disclosure aims to overcome the disadvantages of the current vacuum systems and provides a central vacuum system which combines the advantages of the current vacuum systems. That is, the provided vacuum system is lighter with lower indoor noise, is easier to clean and lower energy consumption. It can be easily moved from place to place and is storage-convenient. The central vacuum system can also avoid the pollution of dust re-entrainment.

In order to achieve the advantages as mentioned, the present disclosure includes the following embodiments. A central vacuum system comprises a first vacuum device which is fixed, a second vacuum device which is movable, and a hose connected between a suction pipe of the first vacuum device and an exhaust pipe of the second vacuum device; the first vacuum device and the second vacuum device are controlled by a linked switch; by decreasing the output of the first fan, or increasing the resistance of sections/parts located behind the hose, or increasing the output of the second fan, or decreasing the resistance of sections/parts located in front of the hose, the interior pressure of the hose remains positive or slightly negative pressure.

In some embodiments, the end of the hose comprises a self-operated differential pressure regulating valve. The self-operated differential pressure regulating valve is capable of generating corresponding air resistance under different air-flow rates.

In some embodiments, the end of the hose comprises a pressure sensor. The pressure sensor and the motor of the first vacuum device are connected to a controller. The controller is capable of controlling a rotate speed of the motor of the first vacuum device.

In some embodiments, the end of the hose comprises the pressure sensor. An electric regulating valve is placed behind the end of the hose. The pressure sensor, the electric regulating valve are connected to the controller. The controller is capable of regulating an opening of the electric regulating valve.

In some embodiments, the end of the hose comprise the pressure sensor. The pressure sensor, the motor of the second vacuum device are connected to the controller. The controller is capable of controlling the rotate speed of the motor of the second vacuum device.

By adopting the above features, the central vacuum system will have lower indoor noise, lower energy consumption, be lighter for handheld, easier to clean. The provided hose can be easily moved from place to place and is storage-convenient. The vacuum system can also avoid the pollution of dust re-entrainment. When the suction port is far away from the surface of the objects to be sucked, the central vacuum system can automatically decrease the energy consumption.

DETAILED DESCRIPTION OF THE DISCLOSURE

The present disclosure will be further specifically described below through the embodiments and the accompanying drawings.

Figure 1:
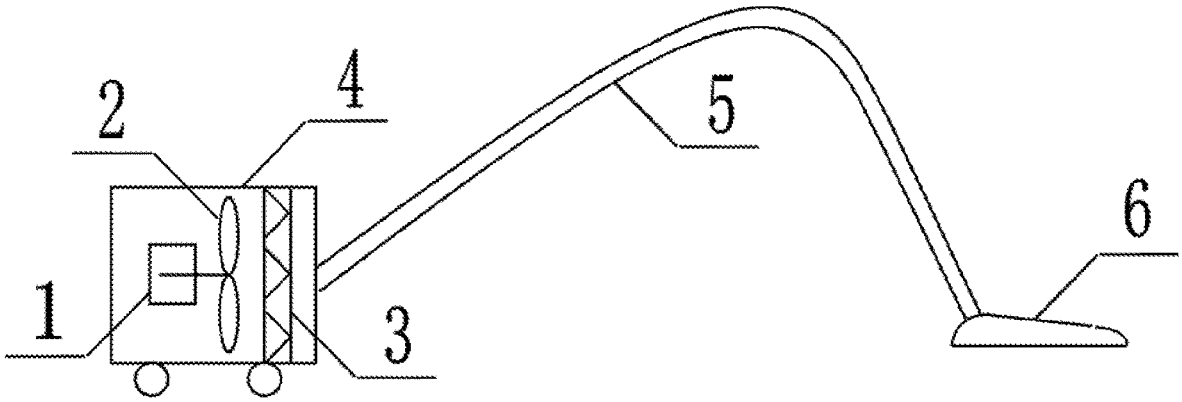
FIG. 1 (Prior Art)
FIG. 1 is a schematic diagram of a household vacuum cleaner in the prior art.
Figure 2:
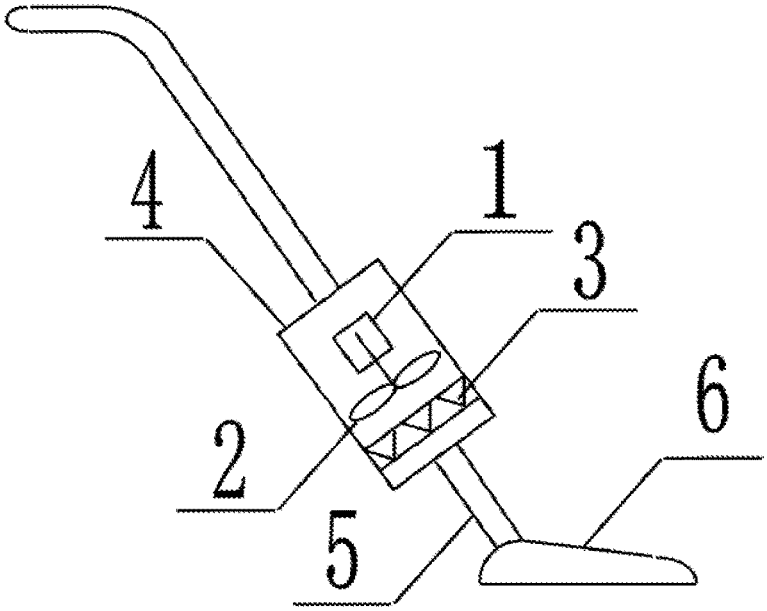
FIG. 2 (Prior Art)
FIG. 2 is a schematic diagram of a handheld vacuum cleaner in the prior art.

FIG. 1 is a schematic diagram of a current household vacuum cleaner, and FIG. 2 is a schematic diagram of a current handheld vacuum cleaner. The vacuum device 4 comprises a motor 1, a fan 2, and a filter 3. The vacuum device 4 is connected to the suction port 6 through a pipeline 5. These components are placed in the same room with the operator. The filtered air will be exhausted to the same room, and some of the unfiltered small-particle dust will stay in the air for a long time, which is known as the dust re-entrainment.

Figure 3:
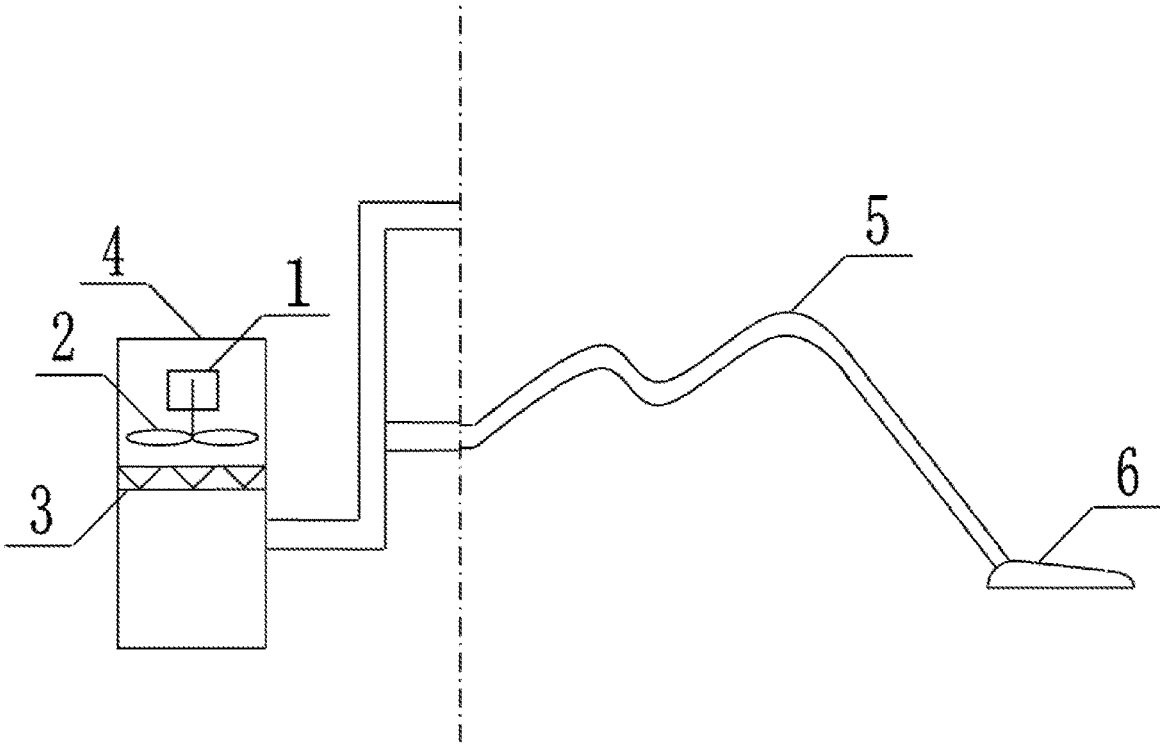
FIG. 3 (Prior Art)
FIG. 3 is a schematic diagram of a central vacuum system in the prior art.

FIG. 3 is a schematic diagram of a current central vacuum system. The vacuum device 4 comprises the motor 1, the fan 2, and the filter 3. The vacuum device 4 and the suction port 6 are connected through the pipeline 5. Generally, the vacuum device 4 is installed outside the room. By doing so, the filtered air will not return to the room and avoid the dust re-entrainment. The pipeline 5 is a hose, but it has to ensure that the suction port 6 can reach all corners of the rooms, and at the same time has sufficient airflow cross-section, and is capable of withstanding high negative air pressure. To this end, the hose is long and bulky, which is very inconvenient for collecting dust. The hose as referred is a flexible hollow tube designed to carry air from one location to another.

Figure 4:
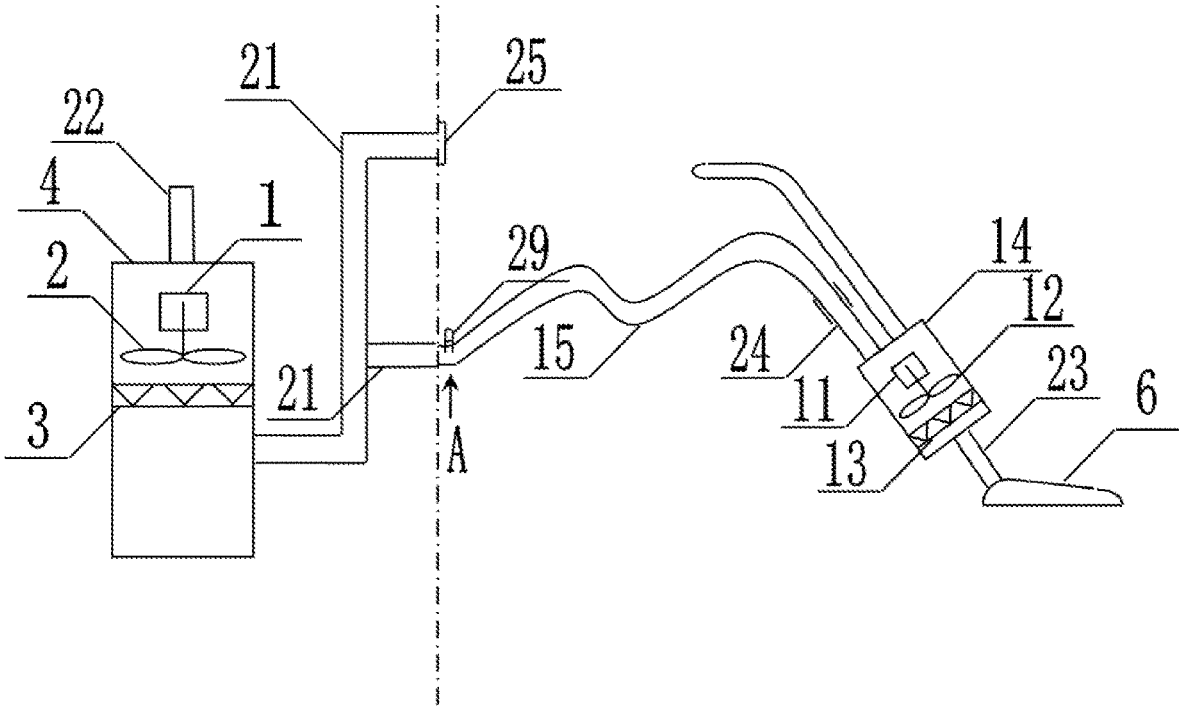
FIG. 4 is a schematic diagram of a central vacuum system according to embodiments of the present disclosure.

FIG. 4 is a schematic diagram of a central vacuum system according to the first embodiments of the present disclosure. The central vacuum system in FIG. 4 at least comprises a first vacuum device 4 which is fixedly installed and a second vacuum device 14 which is movable. The first vacuum device 4 and the second vacuum device 14 are connected through the pipeline 15. When in use, the second vacuum device 14 sucks and filters the objects (e.g., dust, hair, etc.), and then exhausts the unfiltered dust to the first vacuum device 4 through the pipeline 15. The first vacuum device 4 sucks and filters the exhausted dust from the second vacuum device 14.

More specifically, the first vacuum device 4 comprises a first motor 1, a first fan 2, a first filter 3, a first suction pipe 21, and a first exhaust pipe 22. The first motor 1 is connected to the first fan 2 through a spindle of the first motor 1 and rotates the first fan 2 to create negative pressure, and therefore the first vacuum device 4 sucks the dust exhausted from the second vacuum device 14. The sucked dust will be filtered by the first filter 3. The first filter 3 is arranged between the first fan 2 and the first suction pipe 21 or between the first fan 2 and the first exhaust pipe 22. In general, the first motor 1, the first fan 2, the first filter 3, and the first exhaust pipe 22 are placed outside the room. The first suction pipe 21 is installed within the indoor walls. The end of the first suction pipe 21 is the one or more inlet 25, which normally in the state of close, arranged on the indoor walls. As shown in FIG. 4, the dashed line represents the wall, the first vacuum device 4 is installed outside the room. The second vacuum device 14 comprises a second motor 11, a second fan 12, a second filter 13, a second suction pipe 23, a second exhaust pipe 24, and a suction port 6. The second motor 11 is connected to the second fan 12 through a spindle of the second motor 11 to rotate the second fan 12 for creating a negative pressure. The second suction pipe 23 of the second vacuum device 14 is connected to the suction port 6, so that the suction port 6 is capable of collecting the objects (e.g., dust, hair, etc.). The second filter 13 is arranged between the second fan 12 and the second suction pipe 23. The second filter 13 is a primary filter that can filter large-sized dust sucked by the suction port 6 so that the impeller of the second fan 12 and the spindle of the second motor 11 will not be twined by hair or fibers. The filtered air will be sucked by the second fan 12, and then exhausted from the second exhaust pipe 24. The end of the first suction pipe 21 of the first vacuum device 4, i.e., one of any inlet 25 on the indoor walls, is connected to the second exhaust pipe 24 of the second vacuum device 14 through the pipeline 15. In this embodiment, the pipeline 15 is a hose which is a flexible hollow tube designed to carry air and sucked dust from the second vacuum device 14 to the first vacuum device 4. The pipeline 15 is located between a suction side of the first fan 2 and an exhaust side of the second fan 12. The first vacuum device 4 and the second vacuum device 14 are controlled by a linked switch. During use, the air pressure within the pipeline 15 may be positive or negative. This depends on the characteristics of the first fan 2 and the second fan 12, the resistance of the first filter 3 and the second filter 13, the length and the cross-sectional area of the pipeline 15, the gap distance between the suction port 6 and the surface of the sucked objects. Anyway, the air pressure within the pipeline 15 remains higher than the air pressure within the pipeline 5 in FIG. 3. Accordingly, the strength requirement of the pipeline 15 against negative pressure can be much smaller than that of the pipeline 5 in the prior art (referring to FIGS. 1-3), so the pipeline 15 can be lighter than the pipeline 5 in the prior art.

Figure 6:
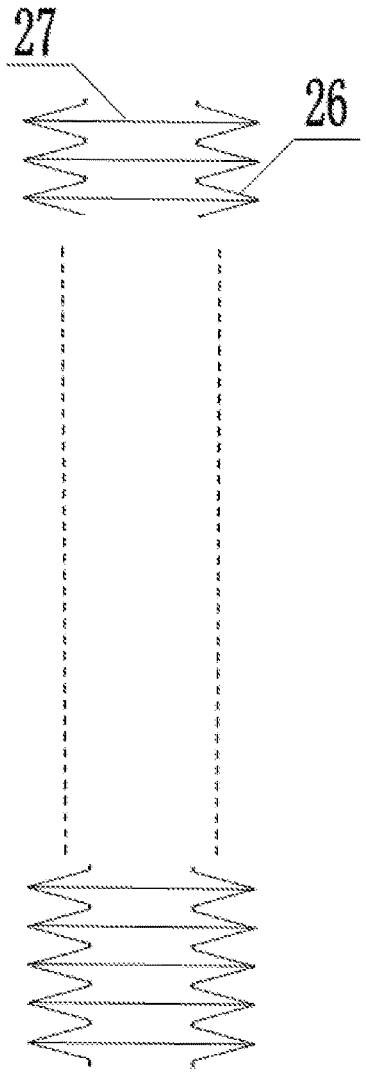
FIG. 6 is a schematic diagram of a corrugated hose.

In the first embodiment as disclosed, the pipeline resistance is different in each vacuum system, the gap distance between the suction port 6 and the surface of the sucked objects is different, and the resistance of the filter varies with the amount of the collected dust, so there are great fluctuations of the air pressure in the pipeline 15, and in extreme cases, the air pressure may be ranged between 15 kPa to −15 kPa. By increasing the output of the second fan 12 while reducing the output of the first fan 2, and reducing the resistance of the second filter 13 or increasing the resistance in the first vacuum device 4, the air pressure in the pipeline 15 can be maintained at positive pressure or slightly negative pressure while remains the same dust collection effect. Namely, the air pressure is controlled at a range between 5 kPa to −1 kPa, avoiding the high negative pressure. If the air pressure in the pipeline 15 remains positive, the pipeline 15 may be made of thin-film material. There is no need to have a skeleton for supporting the thin-film material. The strength of the thin-film material is mainly determined by the material and thickness of thin-film material. The thin-film material may include, but not limited to, TPU(Thermoplastic polyurethanes), PE(polyethylene), PVC(Polyvinyl chloride), LDPE (Low-density Polyethylene), PET (Polyethylene Terephthalate), PA (Polyamide), or the like. If there is negative air pressure within the pipeline 15, the pipeline 15 may be made of thin-film material with the support of a skeleton. Normally, the pipeline 15 made of a corrugated hose 26 as shown in FIG. 6. The skeleton 27 is circular-shaped or spiral-shaped. In general, when the air pressure within the pipeline 15 is greater than −1 kPa, the pipeline 15 will need the support of the skeleton 27 which may be made of the steel wire with a small cross-sectional area. The skeleton 27 can withstand negative pressure of −1 kPa and will not affect the compression and storage of the pipeline 15. At the same time, the skeleton will not affect the retraction and movement of the pipeline 15 during use. When the negative pressure is lower than −1 kPa, it will increase the strength requirements of the thin-film material or the skeleton and will cause inconvenience in use, movement, retraction, compression, and storage of the pipeline 15. The output of the second fan 12 may not be increased overly as that will increase the indoor noise and the weight of the handheld part of the second vacuum device. However, it is feasible to have a similar effect of increasing the output of the second fan 12 by lowering down the resistance of the second filter 13. The similar effect refers to remain the slightly negative pressure and avoid the great negative pressure. In this mean, the second filter 13 only needs to filter objects, such as hair, fiber, etc., that will wind around the impeller of the second fan 12 and the spindle of the second motor 11, and sharp objects that may penetrate the pipeline 15. By this means, the mesh of the second filter 13 may be great than the mesh of the first filer 3, and therefore decreasing the resistance of the second filter 13. The decreased resistance of the second filer 13 may increases the resistance of the first vacuum device 4 accordingly by increasing the airflow rate. When the suction port 6 is close to the surface of the objects to be sucked, or there are tight bends in the pipeline 15 that made of thin-film material because of small bend radius, or the second filter 13 stays uncleared for a long time, the air volume to be sucked by the second vacuum device 14 will be decreased. At this moment, if the first fan 1 remains the same rotate speed, then the pipeline 15 or the pipeline section after the tight bend will be in high negative pressure. Once there is high negative pressure, the skeleton supporting the thin-film material will be deformed or even be sucked flat. The air volume of the whole vacuum system will continue to decrease and the air pressure within the pipeline 15 will continue to decrease, the noise will get louder, and the vacuum effect will get worse. In order to ensure that the air pressure remains greater than −1 kPa even extreme condition, it is generally to decrease the output of the first fan 2, or increase the resistance of sections/parts located behind the pipeline 15, or increase the output of the second fan 12, or decreasing the resistance of sections/parts located in front of the pipeline 15. To be noted, such an arrangement aims to avoid the possible high negative pressure in the extreme condition, but will not reduce the fluctuation of air pressure within the pipeline 15 between 15 kPa to −1 kPa.

Figure 5:
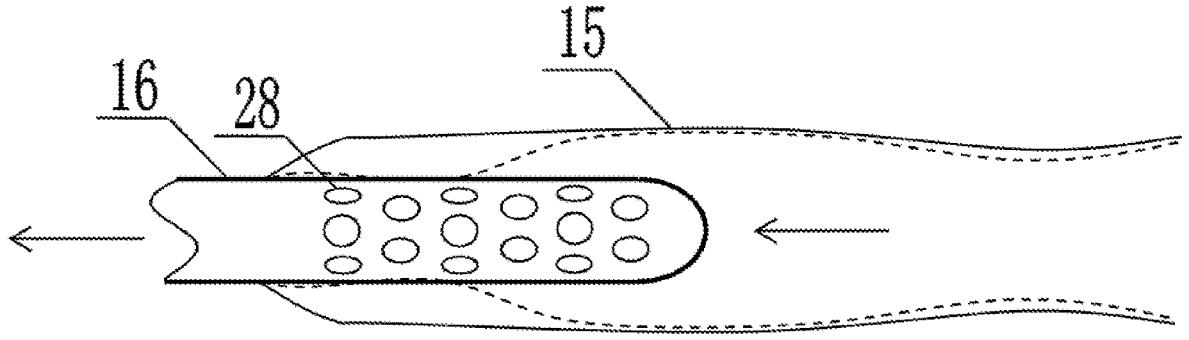
FIG. 5 is a schematic diagram of a self-operated differential pressure regulating valve according to embodiments of the present disclosure.

In the second embodiment of the disclosure, in order to reduce the fluctuation of air pressure within the pipeline 15, a self-operated differential pressure regulating valve is arranged at the end A of the pipeline 15, as shown in FIG. 4. Further referred to FIG. 5, a rigid pipe 16 is shown. One end of the rigid pipe 16 is closed or has a small vent hole, the other end is connected to the opened inlet 25 the end of first suction pipe 21 of the first vacuum device 4. A pipe wall of the rigid pipe 16 is provided with a plurality of air holes 28. The outer side of the rigid pipe 16 is an end of the pipeline 15 which is made thin-film material. When the pressure between the outer side of the rigid pipe and the inner side of the pipeline 15 at the end is positive, the thin-film material will not attach to the outer side of the rigid pipe 16, and the air may flow through all of the air holes 28. When the pressure between the outer side of the rigid pipe and the inner side of the pipeline 15 at the end is negative, the thin-film material will attach to the outer side of the rigid pipe 16 because of the atmospheric pressure, as shown by the broken lines in FIG. 5. Accordingly, part of the air holes 28 at the end of the rigid pipe 16 will be blocked. At this moment, the resistance of the rigid pipe 16 will increase and the airflow rate will decrease. By this means, the other section of the pipeline 15 can remain in stable slightly positive pressure. In this embodiment, the self-operated differential pressure regulating valve is consisted of the rigid pipe 16 having a plurality of air holes 28, and the thin-film material located at the outer side of the rigid pipe 16. The self-operated differential pressure regulating valve is capable of maintaining the air pressure of the pipeline 15 in a stable slightly positive state when the resistance of the pipe and the filter, airflow rate, negative pressure created by the fan are changed in the vacuum system. Similar self-operated differential pressure regulating valve may be used to create a stable slightly positive or negative pressure within the pipeline 15. A stable slightly positive pressure environment within the pipeline 15 can decrease the strength requirement for the thin-film material. A stable slightly negative pressure environment within the pipeline 15 can decrease the strength requirements for the thin-film material and the skeleton while maintaining the corrugated hose contracted during use and barely influencing the free movement and retraction of the second vacuum device 14.

Figure 7:
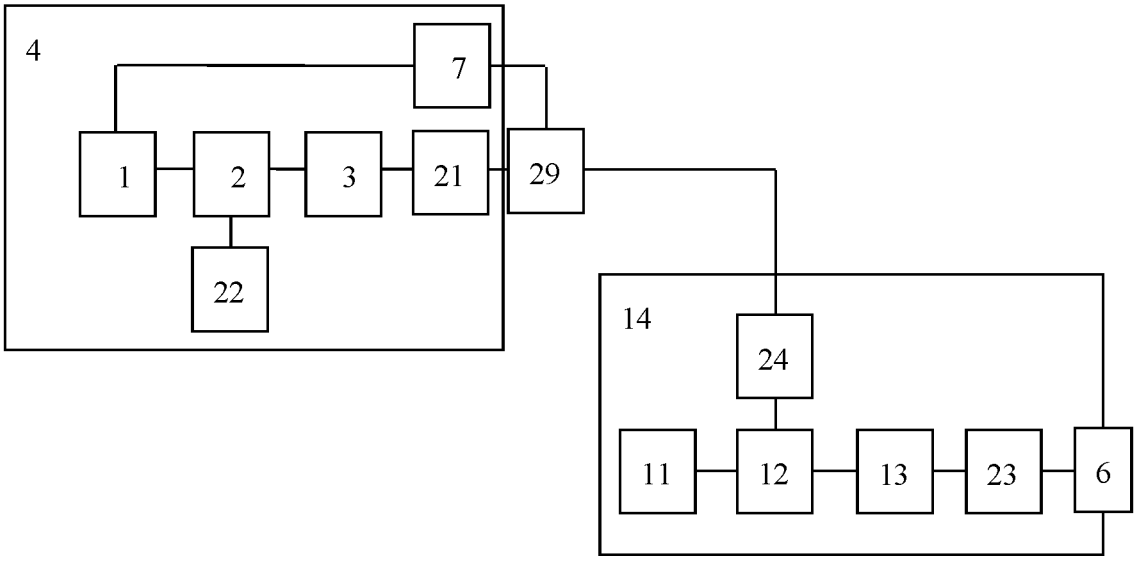
FIG. 7 is a block diagram of the central vacuum system according to one embodiment of the present disclosure.

In the third embodiment of the central vacuum system, a pressure sensor 29 is arranged at the end A of the pipeline 15, as shown in FIG. 4 and FIG. 7, for detecting the pressure within the pipe at the end A. The pressure sensor 29, the first motor 1 of the first vacuum device 4 are connected to a controller 7. The controller 7 is located within the first vacuum device 4 and is capable of controlling the rotate speed of the first motor 1. When the pressure detected by the pressure sensor is greater than the preset pressure value, the first motor is commanded to increase the rotate speed. Contrarily, the first motor is commanded to decrease the rotating speed to maintain the stable slightly positive or negative pressure within the pipeline 15.

Figure 8:
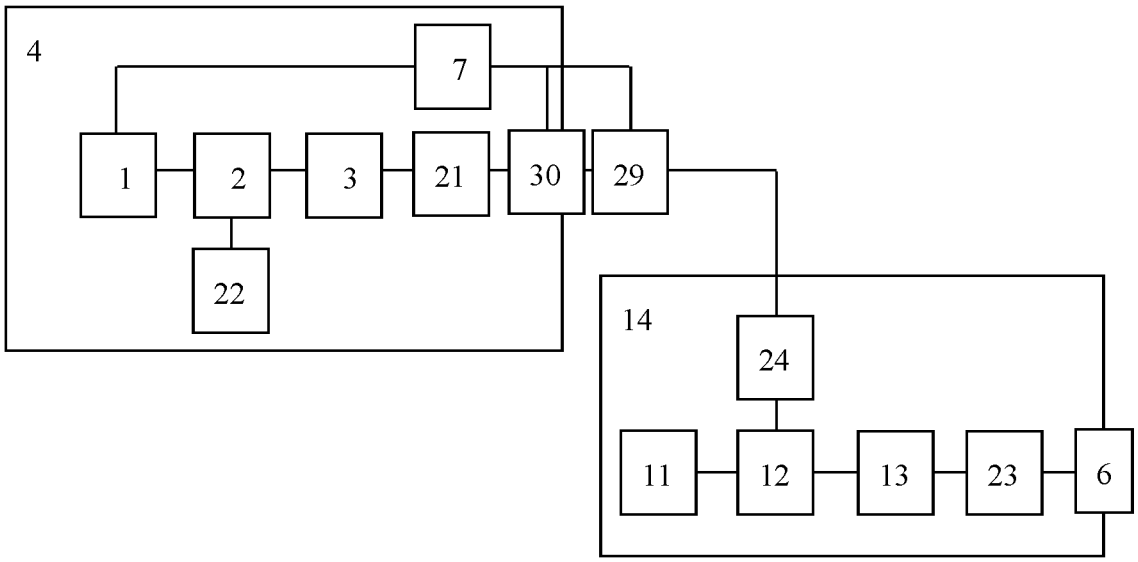
FIG. 8 is a block diagram of the central vacuum system according to another embodiment of the present disclosure.

In the fourth embodiment of the central vacuum system, in case the rotate speed of the first motor 1 cannot be regulated, an electric regulating valve 30 may be installed behind the end of the pipeline 15, as shown in FIG. 4 and FIG. 8. The pressure sensor 29 is arranged at the end A of the pipeline 15, for detecting the pressure within the pipe at the end A. The pressure sensor 29, the electric regulating valve 30 are connected to the controller 7. The controller 7 is located in the first vacuum device 4 or in the electric regulating valve 30, and is capable of maintaining the stable positive or slightly negative pressure in the pipeline 15, by controlling the opening of the electric regulating valve 30 according to the detected pressure from the pressure sensor 29.

In the fifth embodiment of the central vacuum system, a pressure sensor 29 is arranged at the end A of the pipeline 15, as shown in FIG. 4, for detecting the pressure within the pipe at the end A. The pressure sensor 29 and the second motor 11 of the second vacuum device 14 are connected to a controller 7 (not shown). The controller 7 is located within the second vacuum device 14 and is capable of controlling the rotate speed of the second motor 11. When the suction port 6 is far away from the surface of the object to be collected, the air pressure at A will increase. The controller then may command the second motor 11 to decrease the rotate speed, so that the air pressure at A can be maintained slightly greater than or lower than the atmospheric pressure. The power consumption of the second motor 11 will lower down. When the suction port 6 is close to the surface of the object to be collected, the air pressure at A will decrease. The controller 7 then may command to the second motor 11 to increase the rotate speed, so that the air pressure at A can be maintained slightly greater than or lower than the atmospheric pressure. Such a manner can not only satisfy the dust collecting requirement, but also lower down the power consumption of the system.

The fifth embodiment may be combined with the third embodiment or the fourth embodiment. Namely, when the pressure sensor 29 detects a pressure lower than the preset pressure value, the controller will increase the rotate speed of the second motor 11 to the maximum, and then decrease the rotate speed of the first motor 1 or the opening of the electric regulating valve to maintain the pressure within the pipeline 15 slightly greater than or equal to the preset pressure value. Contrarily, the controller will decrease the rotate speed of the second motor 11 to the minimum, and then increase the rotate speed of the first motor 1 to the maximum or enlarge the opening of the electric regulating valve to the maximum. Such operation not only can maintain the air pressure within the pipeline 15 at a stable slightly positive or negative pressure, but also lower down the power consumption of the system.

What is claimed is:

1. A central vacuum system, comprising:

a first vacuum device;

a second vacuum device, and a hose connected between the first vacuum device and the second vacuum device;

wherein the first vacuum device and the second vacuum device are controlled by a linked switch;

an interior pressure of the hose remains positive or slightly negative pressure;

the first vacuum device comprises a first motor, a first fan, a first filter, a first suction pipe, and a first exhaust pipe;

the first motor is connected to the first fan through a spindle of the first motor, and rotates the first fan to create a negative pressure;

the first filter is arranged between the first fan and the first suction pipe, or between the first fan and the first exhaust pipe, and the first filter is capable of filtering dust exhausted from the second vacuum device to the first vacuum device;

the second vacuum device comprises a second motor, a second fan, a second filter, a second suction pipe, a second exhaust pipe and a suction port;

the second motor is connected to the second fan through a spindle of the second motor to rotate the second fan for creating negative pressure, so that the suction port is capable of collecting objects;

the second filter is arranged between the second fan and the second suction pipe, the second suction pipe is connected to the suction port, and an end of the first suction pipe of the first vacuum device is connected to the end of the second exhaust pipe of the second vacuum device through the hose; and by decreasing an output of the first fan, or increasing a resistance of sections/parts located behind the hose, or increasing an output of the second fan, or decreasing a resistance of sections/parts located in front of the hose, the interior pressure of the hose remains positive or slightly negative pressure.

2. The central vacuum system according to claim 1, wherein:

an end of the hose comprises a self-operated differential pressure regulating valve; and the self-operated differential pressure regulating valve is capable of generating corresponding air resistance under different air flow rates so as to maintain the interior of the hose at a stable positive or slightly negative pressure.

3. The central vacuum system according to claim 1, wherein:

an end of the hose comprises a pressure sensor;

the pressure sensor and the first motor of the first vacuum device are connected to a controller; and the controller is capable of controlling a rotate speed of the first motor of the first vacuum device.

4. The central vacuum system according to claim 1, wherein:

an end of the hose comprises a pressure sensor;

an electric regulating valve is located behind the end of the hose;

the pressure sensor and the electric regulating valve are connected to a controller; and the controller is capable of regulating an opening of the electric regulating valve.

5. The central vacuum system according to claim 1, wherein:

an end of the hose comprises a pressure sensor;

the pressure sensor and the second motor of the second vacuum device are connected to a controller; and the controller is capable of controlling a rotate speed of the second motor of the second vacuum device.

* * * * *